US006256820B1

(12) United States Patent
Moser et al.

(10) Patent No.: US 6,256,820 B1
(45) Date of Patent: Jul. 10, 2001

(54) MULTILAYERED POCKETED BEDDING OR SEATING PRODUCT

(75) Inventors: Terry Moser; Niels S. Mossbeck; Thomas J. Wells, all of Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/500,896

(22) Filed: Feb. 9, 2000

(51) Int. Cl.[7] ..... A47C 27/06; B65B 9/08; F16F 3/04

(52) U.S. Cl. ..... 5/655.8; 5/720; 5/721; 5/248; 5/256; 267/93; 267/166

(58) Field of Search ..... 5/655.8, 716, 717, 5/720, 721, 727, 246, 248, 256, 260; 267/91, 93, 103, 166

(56) References Cited

U.S. PATENT DOCUMENTS

| | | | | |
|---|---|---|---|---|
| 1,192,510 | | 7/1916 | Fischman | 5/655.8 |
| 1,717,378 | * | 6/1929 | Gail | 5/721 |
| 1,725,935 | * | 8/1929 | Roeske | 5/721 |
| 1,741,847 | | 12/1929 | Kaspar | 5/655.8 |
| 1,889,236 | | 11/1932 | Burmeister | 426/317 |
| 1,906,893 | | 5/1933 | Young et al. | 5/716 |
| 2,461,062 | | 2/1949 | Kane | 5/720 |
| 2,480,158 | * | 8/1949 | Owen | 267/91 |
| 3,004,266 | | 10/1961 | Blecker | 5/252 |
| 3,256,535 | * | 6/1966 | Anson | 5/248 |
| 3,462,779 | | 8/1969 | Thompson | 5/655.8 |
| 3,668,816 | | 6/1972 | Thompson | 53/418 |
| 3,982,290 | * | 9/1976 | Ward | 5/260 |
| 4,234,984 | | 11/1980 | Stumpf | 5/655.8 |
| 4,439,977 | | 4/1984 | Stumpf | 62/175 |
| 4,485,506 | | 12/1984 | Stumpf et al. | 5/655.8 |
| 4,578,834 | * | 4/1986 | Stumpf | 5/720 |
| 4,854,023 | | 8/1989 | Stumpf | 29/91 |
| 4,907,309 | * | 3/1990 | Breckle | 5/720 |
| 5,016,305 | * | 5/1991 | Suerens et al. | 5/655.8 |
| 5,613,287 | | 3/1997 | St. Clair | 29/91.1 |
| 5,699,998 | | 12/1997 | Zysman | 267/189 |
| 5,713,088 | * | 2/1998 | Wagner et al. | 5/716 X |
| 5,749,133 | | 5/1998 | Mauldin et al. | 29/91.1 |
| 5,792,309 | | 8/1998 | Eto | 156/517 |
| 5,868,383 | * | 2/1999 | Codos | 267/91 X |
| 5,957,438 | * | 9/1999 | Workman et al. | 5/655.8 X |
| 6,036,181 | * | 3/2000 | Workman | 5/655.8 X |
| 6,085,397 | * | 7/2000 | Workman et al. | 5/655.8 X |
| 6,098,968 | * | 8/2000 | Workman | 5/655.8 X |
| 6,131,892 | * | 10/2000 | Stumpf | 267/91 |
| 6,143,122 | * | 11/2000 | Mossbeck et al. | 5/716 X |
| 6,159,319 | * | 12/2000 | Mossbeck | 5/720 X |

FOREIGN PATENT DOCUMENTS

| | | | | |
|---|---|---|---|---|
| 1194621 | * | 10/1985 | (CA) | 5/720 |
| 3232270A1 | | 3/1984 | (DE) . | |
| 4016607 | * | 3/1991 | (DE) | 5/720 |
| 2697420 | * | 5/1994 | (FR) | 5/720 |
| 380582 | * | 9/1932 | (GB) | 5/256 |
| 405261 | * | 1/1934 | (GB) | 5/248 |
| WO99/35081 | | 7/1999 | (WO) . | |
| WO00/00065 | | 1/2000 | (WO) . | |

* cited by examiner

*Primary Examiner*—Terry Lee Melius
*Assistant Examiner*—Robert G. Santos
(74) *Attorney, Agent, or Firm*—Wood, Herron & Evans, LLP

(57) ABSTRACT

A bedding or seating product comprising a spring core made up of a plurality of parallel strings of springs joined to each other. Each of the strings of springs comprises a row of interconnected pocketed coil springs. The pocket of fabric surrounding each of these coil springs is divided into at least two subpockets by at least one line of attachment of opposite sides of the fabric to each other. Each of these subpockets contains one portion of the coil spring, thus resulting in a multilayered product.

27 Claims, 9 Drawing Sheets

MULTILAYERED POCKETED BEDDING OR SEATING PRODUCT

FIELD OF THE INVENTION

This invention relates to spring assemblies for mattresses, cushions and other bedding or seating products.

BACKGROUND OF THE INVENTION

Strings of individually pocketed springs are known. Multiple such strings of springs have been combined in a parallel fashion to create a spring assembly. Each of the coil springs of the string is contained within an individual pocket of fabric which extends from the top to the bottom of the spring. Typically, each of the springs within the string has identical features or characteristics. Consequently, bedding or seating products made from identical strings of pocketed springs have uniform characteristics throughout the bedding or seating product.

Published PCT patent application No. WO 99/35081 discloses a mattress having two layers of pocketed springs. Each of the springs in each layer is individually pocketed, and the springs of the upper layer are directly above the corresponding springs of the lower layer. A pair of such corresponding springs, one above the other, are enclosed in an external cover and separated from one another by a generally horizontal partition wall of fabric. The springs of the upper layer are "softer" than the springs of the lower layer. Thus, this mattress is able to provide a soft upper layer and a harder lower supporting layer. By using springs having different characteristics in the different layers of the mattress, differing degrees of firmness may be imparted to the mattress.

In order to make such a mattress, a large number of coil springs must be used. For every lower spring, there must be a corresponding upper spring directly above it. Additionally, each of these springs must be individually pocketed. This large number of coil springs and the effort required to individually pocket each spring increases the cost of manufacturing the mattress, and also the time required to manufacture it. Additionally, the upper spring may move sideways relative to the lower spring, causing the springs to move out of alignment with one another and create a bump, indentation or uneven spot in the mattress. Another possibility with such a mattress is that the spring of the upper layer may rotate relative to the spring of the lower layer, reducing the ability of the mattress to function as desired.

Therefore, it has been one objective of the present invention to provide a multilayered bedding or seating product made of individually pocketed springs without using different springs for the upper and lower layers.

Another objective of the present invention has been to provide a pocketed bedding or seating product made of a plurality of similarly constructed strings of pocketed springs joined together.

Still another objective of the present invention has been to provide a pocketed bedding or seating product which may be custom manufactured for a particular application.

SUMMARY OF THE INVENTION

The invention of this application which accomplishes these objectives comprises a bedding or seating product. The bedding or seating product comprises a spring core and an upholstered covering surrounding the spring core. The spring core comprises a plurality of parallel strings of springs joined together. Each of the strings of springs comprises a row of interconnected pocketed coil springs. Each of the pocketed coil springs comprises a coil spring surrounded with a pocket of fabric, as is conventional.

However, the coil springs of the string of springs may not be conventional; i.e., they may not have uniform characteristics from top to bottom as do conventional coil springs. However, it is envisioned that coil springs utilized in the practice of this invention may in at least one embodiment be conventional coil springs having the same physical properties or characteristics, i.e. pitch, coil diameter, wire thickness (guage), heat treatment, etc., from top to bottom. In several preferred embodiments of this invention though, the coil springs have at least two distinctly different portions, each portion of which has at least one different physical characteristic than at least one other portion of the spring.

For example, in one embodiment of the present invention, each of the springs has two portions, an upper portion and a lower portion. At least one characteristic of the upper portion is different than the corresponding characteristic of the lower portion, i.e., the upper portion being a different gauge wire or a different pitch than the lower portion of the spring. Each of the springs has the same set of characteristics and is similarly oriented, resulting in a bedding or seating product with a uniform hardness or "feel" on one surface. However, when the bedding or seating product is flipped over, the bedding or seating product will have a different firmness or "feel" due to the different characteristics of the springs.

In another embodiment of the present invention, each of the springs has three portions: a pair of end portions and a middle portion therebetween. The characteristics of the ends portions are identical but yet different from the characteristics of the middle portion of the spring. A bedding or seating product made from such strings of springs has the same firmness or "feel" no matter which side of the mattress is facing up.

The concept of the present invention may also be used to posturize a bedding or seating product, i.e., make certain regions or portions firmer than other areas or portions of the bedding or seating product. This is accomplished by grouping together multiple strings of springs having identical characteristics in one region of a bedding or seating product. The strings of springs of the other regions have different characteristics so as to impart different firmnesses to the different regions.

Within a string of springs, each pocket of fabric is divided into at least two subpockets by at least one line of attachment. Each line of attachment preferably comprises at least one weld joining opposite sides or plies of the fabric to each other. The line of attachment may be a continuous or broken line. The plies may be welded, sewn or otherwise secured together. The line(s) of attachment is/are located so that each of the subpockets contains one of the portions of the coil spring. Thus the bedding or seating product is multilayered, each layer comprising a plurality of subpockets, each of the subpockets containing a portion of a coil spring.

The bedding or seating product typically has a longitudinal dimension and a transverse dimension, the longitudinal dimension being greater than the transverse dimension. However, the longitudinal dimension and transverse dimension may be identical in a square bedding or seating product. In the invention of the present application, the strings of springs may extend longitudinally or transversely, depending upon the desired effect.

Adjacent strings of springs of the bedding or seating product are preferably glued together but may be otherwise secured to each other. At least one border wire may extend around the perimeter of the bedding or seating product and is secured to select outermost pocketed coil springs. A first or lower border may be secured to the lower end turns of the coil springs of the outermost strings. A second or upper border wire may be secured to the upper end turns of the coil springs of the outermost strings or, alternatively, secured to intermediate convolutions of the coil springs of the outermost strings of springs. When secured to intermediate convolutions of the outermost coil springs, the upper border wire is spaced downwardly below the upper end turns of the springs. In either case the upper border wire is generally horizontally oriented and defines a generally horizontal plane. In the event the upper border wire is spaced below the upper surface of the strings of springs, one of the subpockets of each of the pocketed springs is located above the generally horizontal plane defined by the upper border wire. If the upper border wire is placed in such a location, the upper portions of springs located above the generally horizontal plane may be made softer or less resilient than the lower portions of the springs below the generally horizontal plane, thus providing the bedding or seating product with a cushioning, soft upper layer above the main body of the bedding or seating product. These and other objects and advantages of the present invention will be more readily apparent from the following drawings.

DETAILED DESCRIPTION OF THE DRAWINGS

Figure 1A:
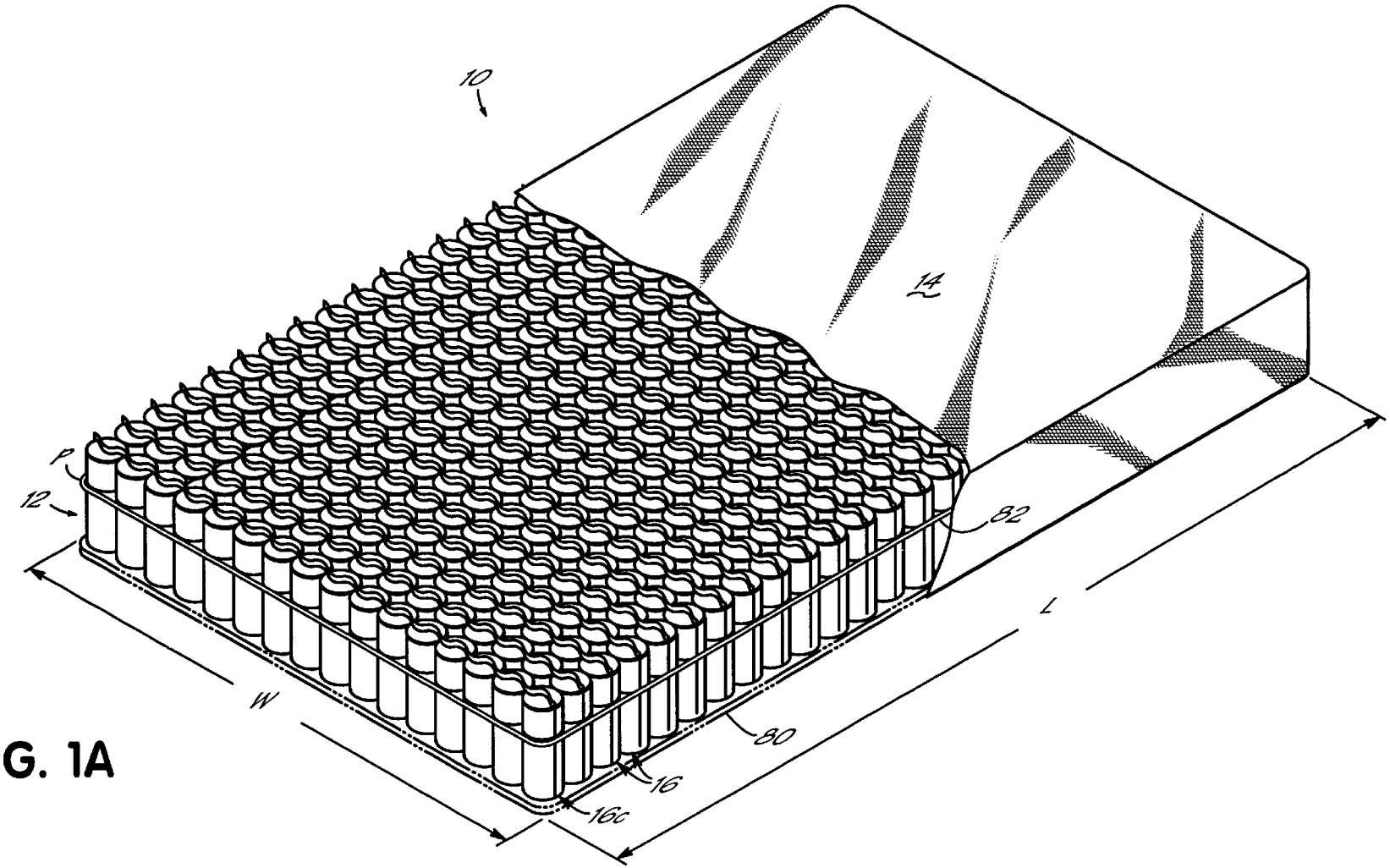
FIG. 1A is a perspective view of a bedding product made in accordance with the invention of this application comprising a plurality of transversely extending strings of springs surrounded by a generally rectangular border wire.

Referring to the drawings, and particularly to FIG. 1A, there is illustrated a bedding or seating product 10 comprising a spring core 12 and an upholstered covering 14 surrounding the spring core 12. The spring core 12 comprises a plurality of parallel strings of springs 16.

Figure 2A:
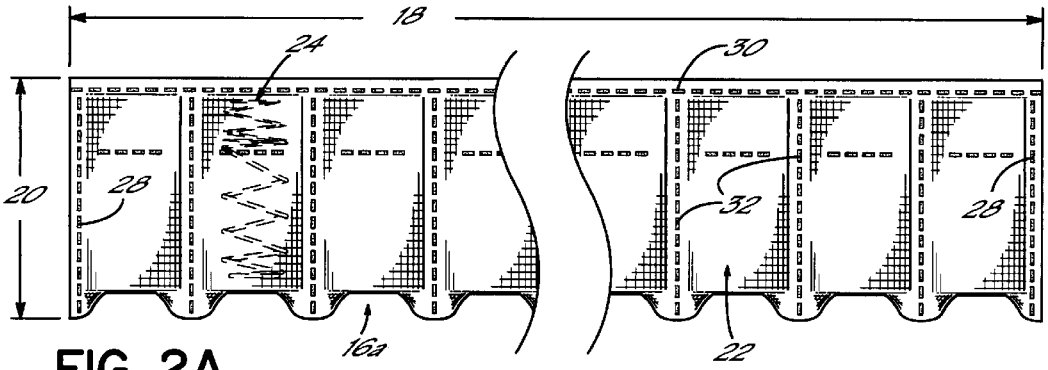
FIG. 2A is a side elevational view, partially broken away, of a string of springs made in accordance with one embodiment of the present invention.
Figure 3A:
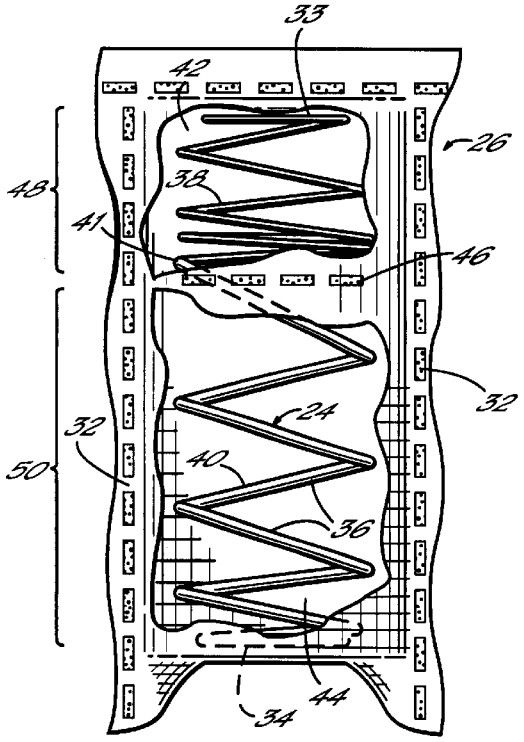
FIG. 3A is a side elevational view, partially cut away, of a portion of the string of springs of FIG. 2A.

One embodiment of the present invention is illustrated in FIGS. 2A and 3A. In this embodiment the spring core 12 comprises a plurality of strings of springs 16*a*, one of which is illustrated in FIG. 2A. As illustrated in FIG. 2A, the string of springs 16*a* has a longitudinal dimension or length 18 and a height 20. The string of springs 16*a* comprises a row of interconnected fabric pockets 22, each containing a coil spring 24. The combination of the coil spring 24 and the fabric pocket 22 is considered a pocketed coil spring 26. One such pocketed coil spring 26 is illustrated in FIG. 3A. As is known in the art, each string of springs 16*a* comprises a piece of fabric folded over on itself encapsulating a plurality of parallel springs 24. Opposite sides or plies of the fabric are sewn, welded or otherwise secured together in order to create a pair of outmost seams 28, a top seam 30 and a plurality of interior seams 32 which separate adjacent coil springs 24 from one another. Although the seams 28, 30 and 32 are each illustrated as being a plurality of spaced, linear segments, they may comprise continuous lines or a series of dots as well without departing from the spirit of this application.

Referring to FIG. 3A, each of the pocketed coil springs 26 of the present invention comprises a coil spring 24 enclosed in a fabric pocket 22. The coil spring 24 has an upper end turn 33, a lower end turn 34 and a plurality of central convolutions 36 therebetween. In one embodiment, each of the coil springs 24 has uniform physical properties throughout. In another embodiment of the present invention, each of the coil springs 24 has a first portion 38 and a second portion 40, each of the portions having different physical characteristics such as different thicknesses, coil pitches, coil diameters, heat treatments, etc. In the coil spring 24 illustrated in FIG. 3A, the first portion 38 of the coil spring 24 is located above the second portion 40 of the coil spring 24 and has a greater helical pitch than the second portion 40. Additionally, the first portion 38 is made of a thinner gauge wire than the second portion 40 of the coil spring 24. At location 41 the coil spring 24 changes characteristics.

As illustrated in FIGS. 2A and 3A, the individual fabric pocket 22 in which is located the coil spring 24 is divided into at least two subpockets 42 and 44 by a line of attachment 46 of opposed plies of the fabric pocket together. A first or upper subpocket 42 contains the first portion 38 of the coil spring. A second or lower subpocket 44 contains the second portion 40 of the coil spring. Thus, the generally horizontally oriented line of attachment 46 divides the pocketed coil spring 26 into two layers, an upper layer 48 and a lower layer 50. In at least one embodiment of the present invention, the upper layer 48 has different characteristics than the lower layer 50 due to the nature of the spring portions 38,40 inside the subpockets 42,44. In the product illustrated in FIGS. 2A and 3A, the upper layer 48 has a soft feel, whereas the lower layer 50 has a more firm, stronger feel due to the characteristics of the portions 38,40 of coil springs 24 located in the respective subpockets 42,44.

Figure 2B:
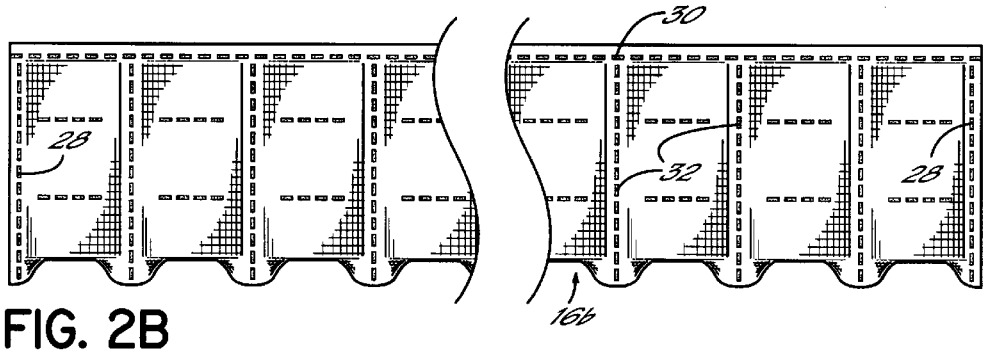
FIG. 2B is a side elevational view, partially broken away, of a string of springs made in accordance with a second embodiment of the present invention.
Figure 3B:
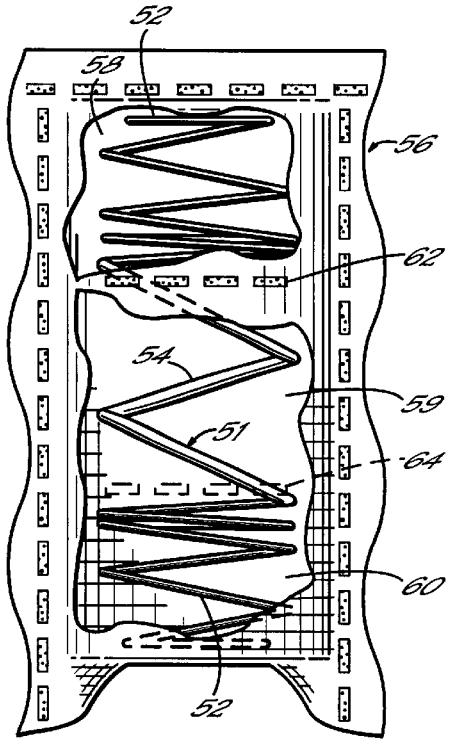
FIG. 3B is a side elevational view, partially cut away, of a portion of the string of springs of FIG. 2B.

FIGS. 2B and 3B illustrate an alternative embodiment of the present invention. In this embodiment, each coil spring 51 within a string 16*b* of coil springs is divided into three portions: a pair of end portions 52 and a middle portion 54 therebetween. As illustrated in FIG. 3B, each of the end portions 52 has identical characteristics different from the characteristics of the middle portion 54. The entire coil spring 51 is encapsulated in a fabric pocket 56. The fabric pocket 56 is divided into three subpockets 58, 59 and 60 by a pair of lines of attachment 62 and 64. Line of attachment 62 separates subpockets 58 and 59 and line of attachment 64 separates subpockets 59 and 60. End portion 52 of the coil spring 51 is located in subpocket 58, middle portion 54 inside subpocket 59 and end portion 52 inside subpocket 60.

A spring core made of a plurality of strings of springs 16*b* (seen in FIG. 2B) has the same firmness on the top and bottom surfaces of the spring core. Thus, a bedding or seating product made of a plurality of strings of springs 16*b* joined together has the same feel no matter which side of the mattress is upwardly directed or exposed.

Figure 4:
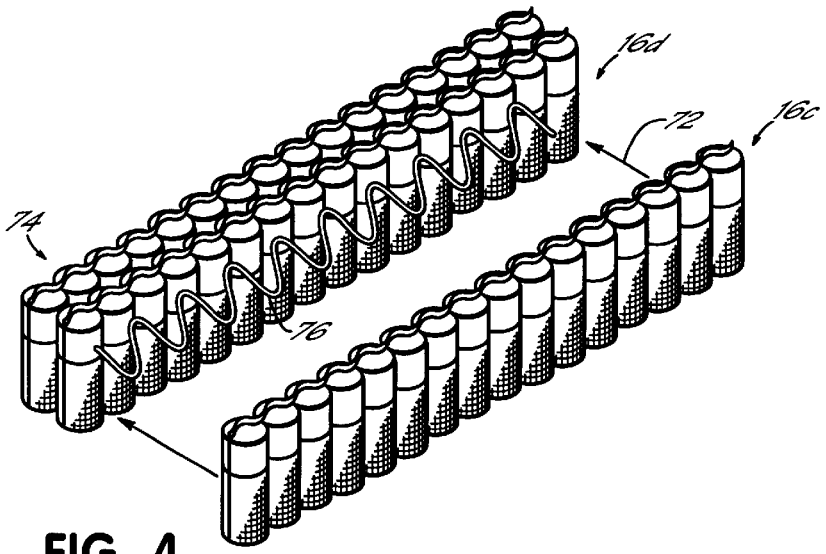
FIG. 4 is a perspective view of a string of springs being joined to a portion of a spring core.

One method of manufacturing the spring core 12 of the bedding or seating product 10 is illustrated in FIG. 4. This method comprises joining a plurality of parallel string of springs 16 to each other.

Referring to FIG. 4, a string of springs 16*c* is moved in the direction of arrows 72 until it abuts an outermost string of springs 16*d* which is part of a subassembly 74 made of a plurality of strings of springs (two being shown). A sinuous-shaped glue line 76 is placed on the outer surface of the fabric of the string of springs 16*d*. When string of springs 16*c* abuts against the string of springs 16*d*, pressure is applied and the glue is allowed to dry, thus securing the string of springs 16*c* to the string of springs 16*d*. Although a sinuous-shaped line of glue is illustrated and described, the glue may assume other shapes and configurations such as individual dots or a plurality of linear segments, for example. Other attachment methods such as hog rings, welds or any other type of fastener may be used to secure adjacent strings of springs to each other.

Referring to FIG. 1A, the bedding or seating product 10 has a longitudinal dimension L and a transverse dimension W, the longitudinal dimension L being greater than the transverse dimension W. As illustrated in FIG. 1A, the strings of springs 16 may extend transversely (parallel the transverse dimension W). Alternatively, as illustrated in FIG. 1B, the strings of springs 16 may extend longitudinally (parallel the longitudinal dimension L).

Figure 1B:
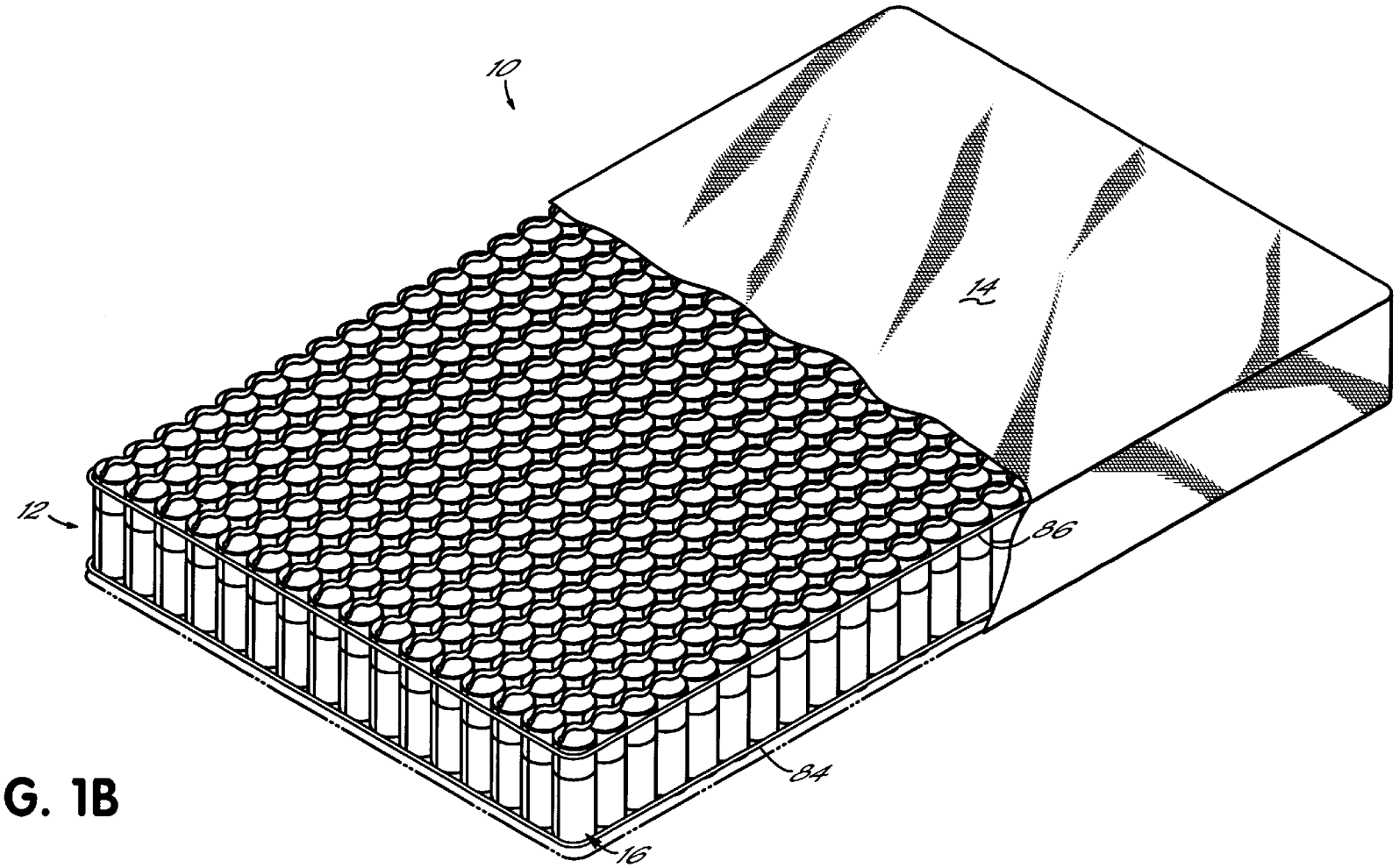
FIG. 1B is a perspective view of a bedding product made in accordance with the present invention, the strings of springs extending longitudinally and being surrounded by a generally rectangular border wire.

As illustrated in FIGS. 1A and 1B, a least one border wire may extend around the perimeter of the spring core 12. FIG. 1A illustrates a lower border wire 80 secured to the lower end turns 34 of the outermost coil springs 24 of the spring core 12. FIG. 1A also illustrates an upper border wire 82 surrounding the spring core 12. The upper border wire 82 is secured to intermediate convolutions 36 of the coil springs 24 and is spaced a distance below the upper end turns 33 of the coil springs 24. The border wire 82 is generally horizontally oriented, defining a horizontal plane P. The upper border wire 82 is preferably at the location 41 (see FIG. 3A) at which the characteristics of the coil springs 24 change so that the upper or first portion 38 of coil spring 24 above the border wire having one set of characteristics is located above the upper border wire 82, and the lower or second portion 40 of coil spring 24 having a different set of characteristics is located below the border wire 82. The upper subpockets 42 are located above the plane P, and the lower subpockets 44 of the strings of springs are located below the border wire 82 and horizontal plane P, thus dividing the spring core 12 into upper and lower layers.

FIG. 1B illustrates a plurality of strings of springs 16 longitudinally oriented, a lower border wire 84 and an upper border wire 86.

The lower border wire 84 is secured to the lower end turns 34 of the outermost coil springs of the spring core, and the upper border wire 86 is secured to the upper end turns 33 of the outermost coil springs of the spring core, as is conventional. Depending on the desired effect, the upper border wire 86 may be secured to the upper end turns or the intermediate convolutions of the outermost springs regardless of which direction the strings of springs are oriented.

Figure 5A:
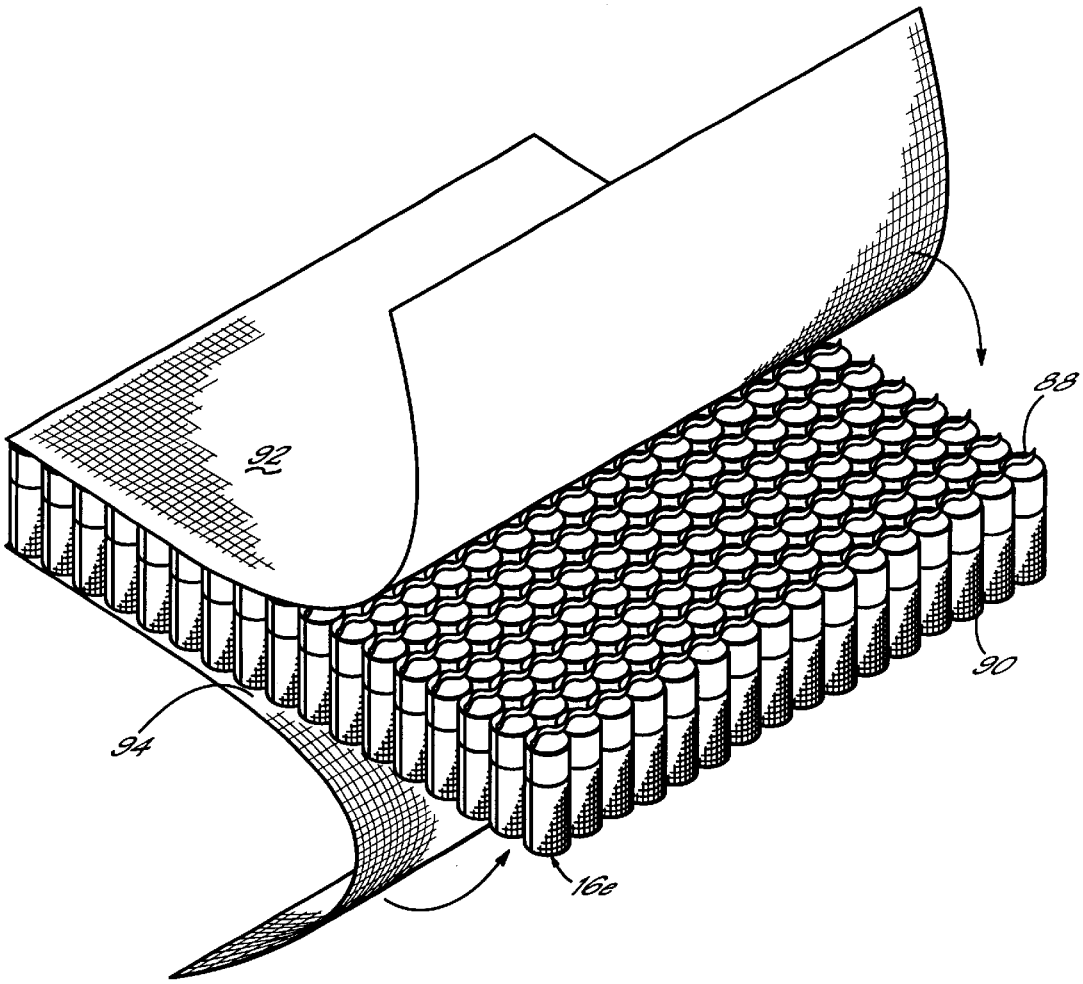
FIG. 5A is a perspective view of a method of manufacturing a spring core made of a plurality of strings of springs joined together at least in part by upper and lower scrim sheets.
Figure 5B:
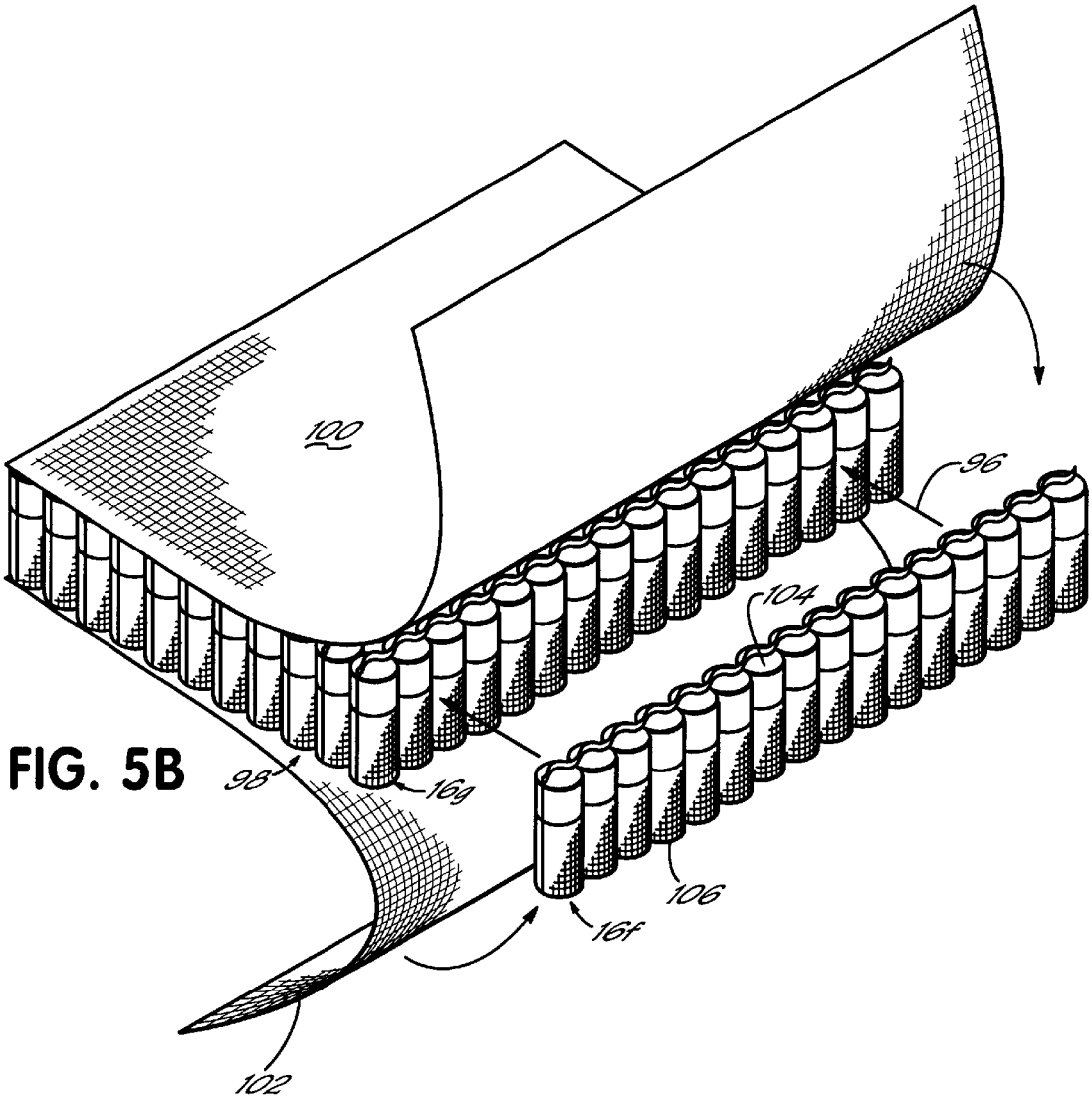
FIG. 5B is a perspective view of an alternative method of manufacturing a spring core made up of strings of springs held together at least in part by upper and lower scrim sheets.

FIGS. 5A and 5B illustrate alternative methods of combining multiple strings of springs of the present invention into a spring core. Referring to FIG. 5A, a plurality strings of springs 16*e*, each having an upper surface 88 and a lower surface 90, are aligned. An upper scrim sheet 92 is glued or otherwise secured to the upper surfaces 88 of each of the strings of springs 16 and, similarly, a lower scrim sheet 94 is glued or otherwise secured to the lower surfaces 90 of the strings of springs 16.

An alternative method of joining multiple strings of springs using scrim sheets is illustrated in FIG. 5B. Using this method, one string of springs 16*f* is moved in the direction of arrows 96 until it abuts the outermost string of springs 16*g* of a partial spring core 98. Once in such a location, the upper and lower scrim sheets 100,102 may be secured to the upper and lower surfaces 104,106, respectively, of the string of springs 16*f*. One at a time an additional string of springs is secured to the scrim sheets 100 and 102 until the appropriate length and width of spring core is obtained. Additionally, if desired, string of springs 16*f* may be secured to the outermost string of springs 16*g* of partial spring core 98 with glue (see FIG. 4).

Figure 6A:
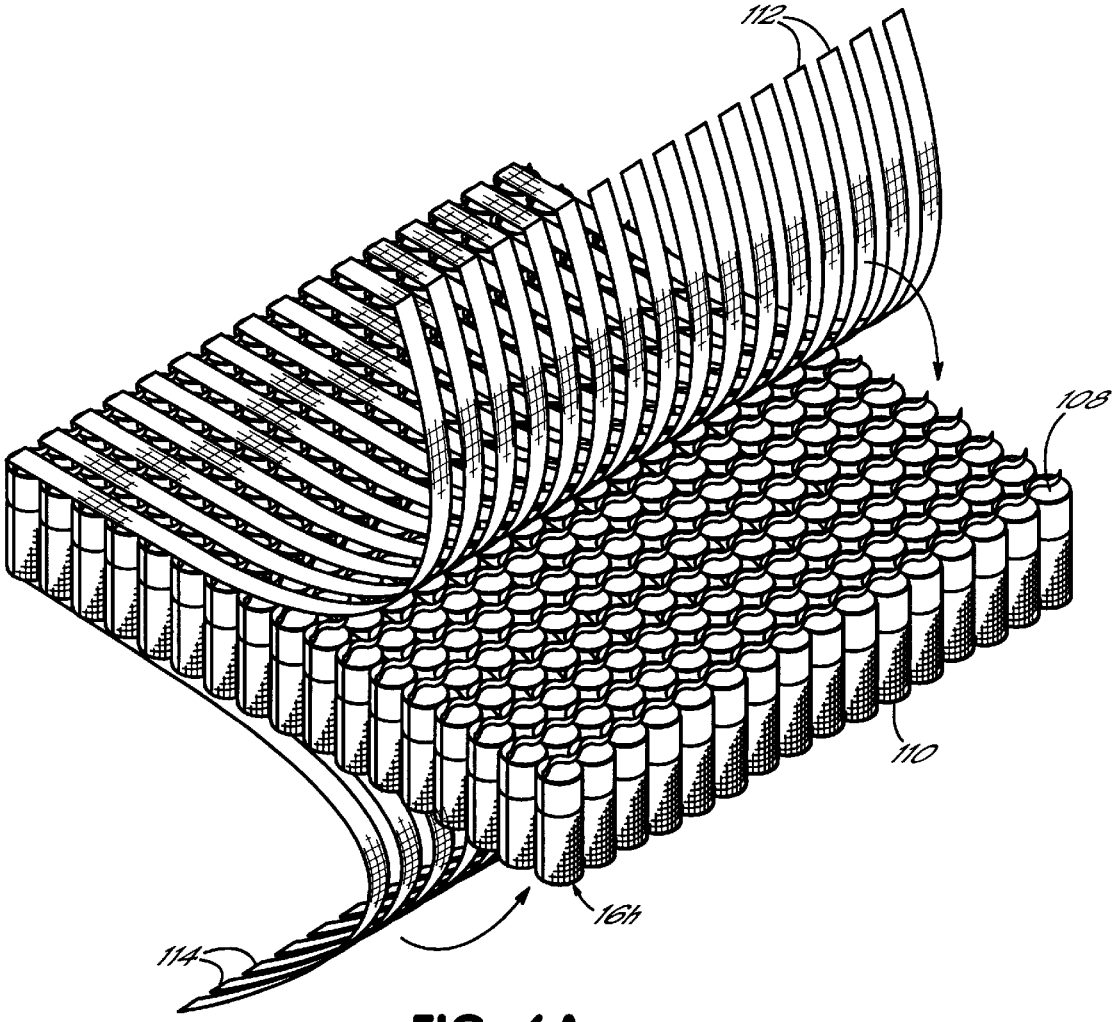
FIG. 6A illustrates a method of manufacturing a spring core made up of a plurality of strings of springs held together with supplemental fabric strips, the supplemental fabric strips being perpendicular to the longitudinal dimension of the strings of springs.

FIGS. 6A, 6B, 7A and 7B illustrate alternative methods of joining together multiple strings of springs to create a spring core. FIG. 6A illustrates a plurality of transversely extending strings of springs 16*h*, each string of springs 16*h* having an upper surface 108 and a lower surface 110.

A plurality of spaced parallel supplemental fabric strips 112 are secured to the upper surfaces 108 of the strings of springs 16*h*, and a plurality of parallel spaced supplemental fabric strips 114 are secured to the lower surfaces 110 of the parallel strings of springs 16*h*. In the method illustrated in FIG. 6A, all the strings of springs 16*h* are aligned before the supplemental fabric strips 112,114 are attached to the upper and lower surfaces 108,110 of the strings of springs 16*h*.

Figure 6B:
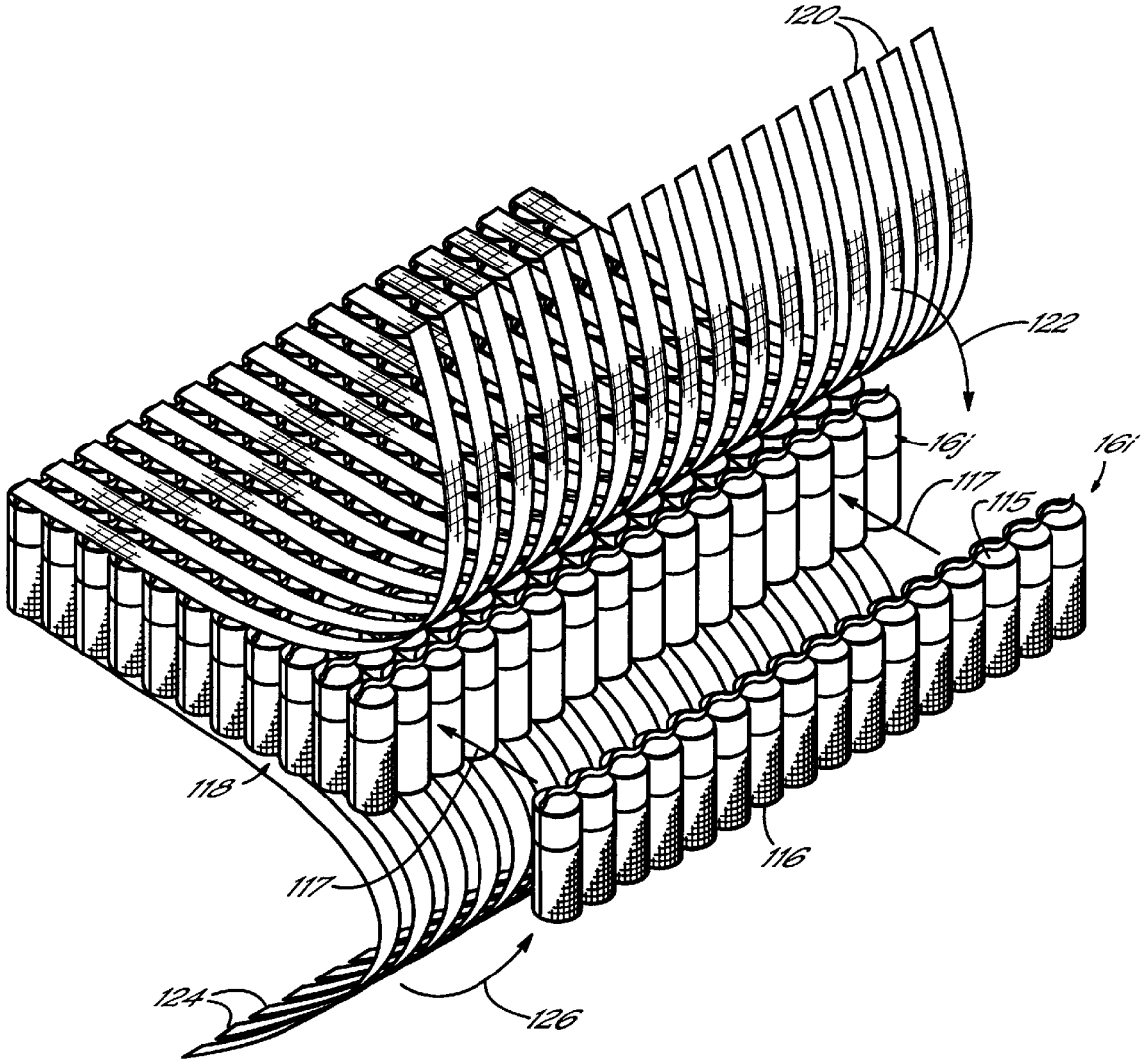
FIG. 6B illustrates an alternative method of manufacturing a spring core made up of a plurality of strings of springs held together with supplemental fabric strips, the supplemental fabric strips being perpendicular to the longitudinal dimension of the strings of springs.

FIG. 6B illustrates an alternative method of creating a spring core. Using this method one transversely extending string of springs 16*i* is moved in the direction of arrows 117 until it abuts an outermost string of springs 16*j* of a partial spring core 118. Each of the strings of springs 16*i* has an upper surface 115 and a lower surface 116. Upper supplemental fabric strips 120 are then lowered downwardly in the direction of arrow 122 and secured to the upper surface 115 of the outermost string of springs 16*i*. Likewise, lower supplemental fabric strips 124 are raised in the direction of arrow 126 and glued or otherwise secured to the lower surface 116 of the outermost string of springs 16*i*. Utilizing this method, strings of springs are secured one at a time to the partial spring core until the desired size of spring core is created.

Figure 7A:
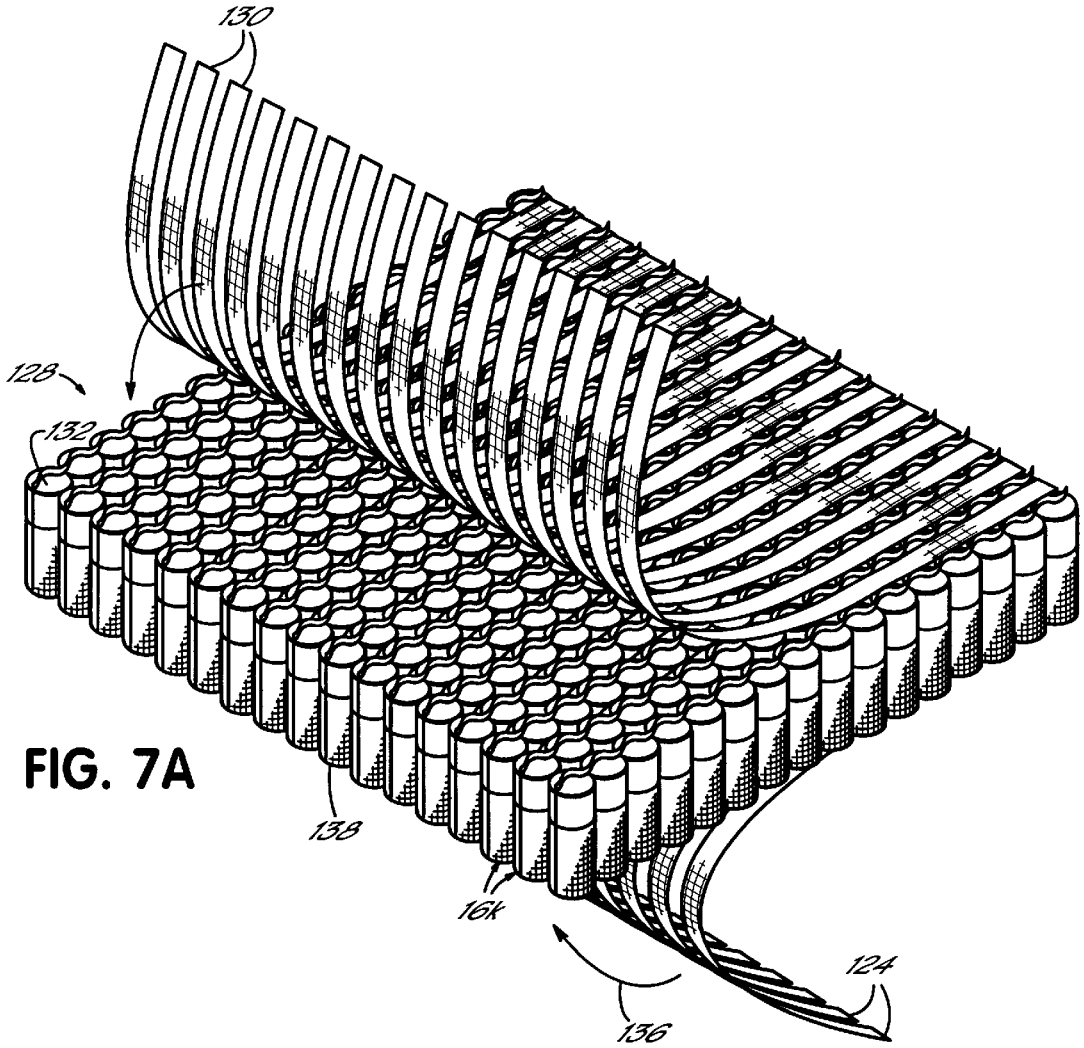
FIG. 7A illustrates a method of manufacturing a spring core made up of a plurality of strings of springs held together with supplemental fabric strips, the supplemental fabric strips being parallel the longitudinal dimension of the strings of springs.

FIG. 7A illustrates a spring core 128 made up of a plurality of parallel strings of springs 16*k* which are extending longitudinally. A plurality of parallel upper supplemental fabric strips 130 are secured to the upper surfaces 132 of the strings of springs 16*k*, each supplemental fabric strip 130 being joined to two adjacent strings of springs. Similarly, lower supplemental fabric strips 134 are moved in the direction of arrow 136 and secured to the lower surfaces 138 of the strings of springs 16*k*.

Figure 7B:
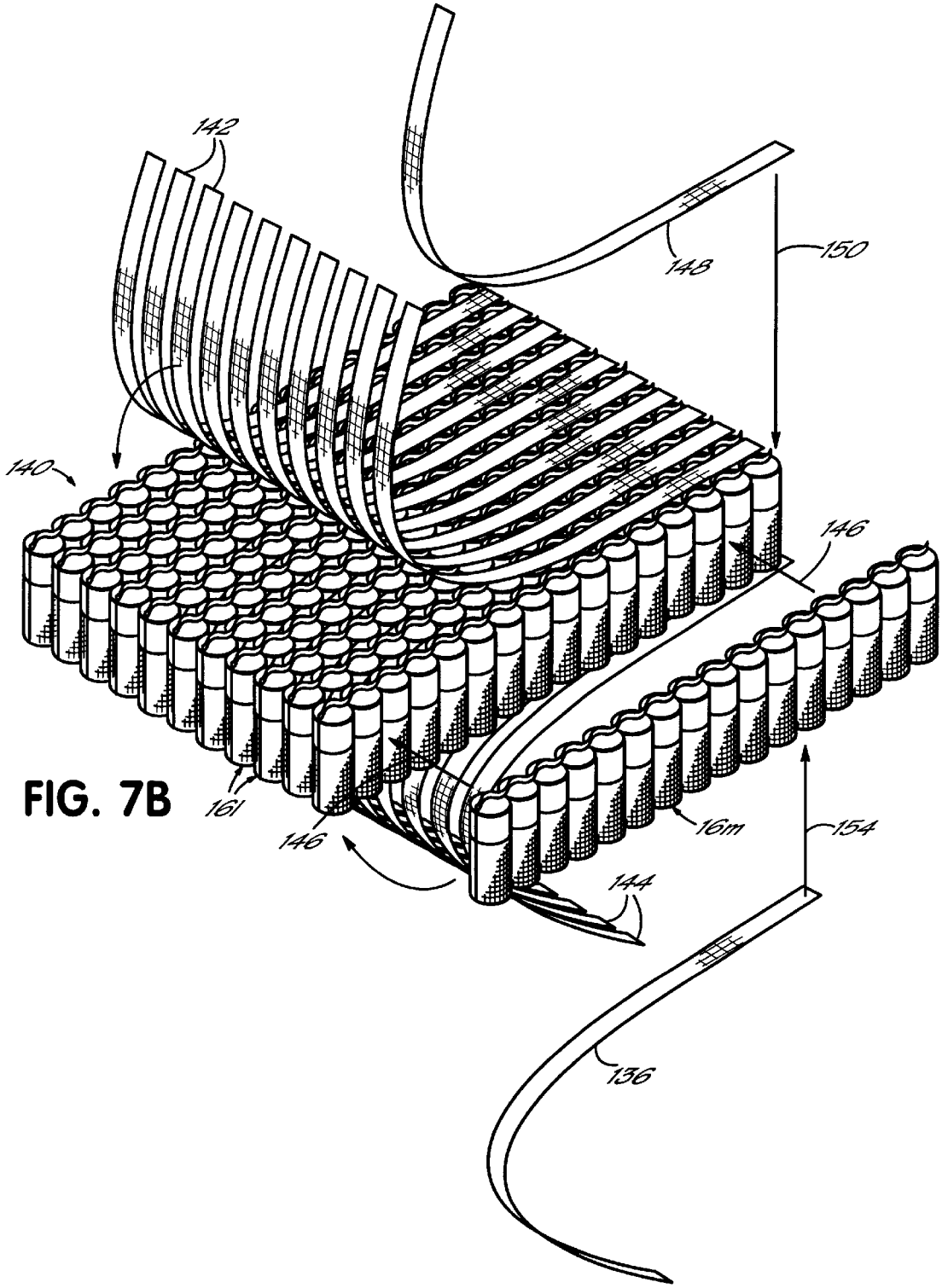
FIG. 7B illustrates an alternative method of manufacturing a spring core made up of a plurality of strings of springs held together with supplemental fabric strips, the supplemental fabric strips being parallel the longitudinal dimension of the strings of springs.

Referring to FIG. 7B, a partial spring core 140 having a plurality of upper supplemental fabric strips 142 and lower supplemental fabric strips 144 securing a plurality of strings of springs 16*l* together may be increased in size by adding an additional string of springs 16*m* in the direction of arrows 146. An additional upper supplemental fabric strip 148 is moved downwardly in the direction of arrow 150 and secured to the upper surfaces of adjacent strings of springs 16*l* and 16*m*. Similarly, lower supplemental fabric strip 152 is moved upwardly in the direction of arrow 154 and joined to the lower surfaces of strings of springs 16*l* and 16*m*.

Although we have described several preferred embodiments of our invention, we do not intend to be limited except by the scope of the following claims.

We claim:

1. A bedding or seating product comprising:

a spring core comprising a plurality of parallel strings of springs, each of said strings of springs comprising a row of interconnected pocketed coil springs, each of said pocketed coil springs comprising a coil spring surrounded by a pocket of fabric, at least selected ones of said pockets of fabric being divided into at least two subpockets by at least one line of attachment, each of said subpockets containing one portion of one of said coil springs; and an upholstered covering surrounding said spring core.

2. A bedding or seating product comprising:

a spring core comprising a plurality of parallel strings of springs, each of said strings of springs comprising a row of interconnected pocketed coil springs, each of said pocketed coil springs comprising a coil spring surrounded by a pocket of fabric, at least selected ones of said pockets of fabric being divided into at least two subpockets by at least one line of attachment, each of said subpockets containing one portion of one of said coil springs.

3. The bedding or seating product of claim 2 wherein at least selected ones of said coil springs have at least two portions of different characteristics.

4. The bedding or seating product of claim 2 wherein said product has a longitudinal dimension and a transverse dimension, said longitudinal dimension being greater than said transverse dimension, said strings of springs extending longitudinally.

5. The bedding or seating product of claim 2 wherein said product has a longitudinal dimension and a transverse dimension, said longitudinal dimension being greater than said transverse dimension, said strings of springs extending transversely.

6. The bedding or seating product of claim 2 further comprising at least one border wire extending around strings of coil springs, said at least one border wire being secured to select outermost pocketed coil springs.

7. The bedding or seating product of claim 2 wherein a border wire is secured to said spring core and defines a generally horizontal plane, one of said subpockets of each of said pocketed coil springs being above said generally horizontal plane.

8. The bedding or seating product of claim 2 wherein adjacent strings of springs are glued together.

9. The bedding or seating product of claim 2 wherein each of said strings of springs is secured to at least one scrim sheet.

10. The bedding or seating product of claim 2 wherein said strings of springs are held together with supplemental fabric strips.

11. The bedding or seating product of claim 10 wherein said supplemental fabric strips are transversely extending.

12. The bedding or seating product of claim 10 wherein said supplemental fabric strips are longitudinally extending.

13. A string of springs for inclusion in a bedding or seating product, said string of springs comprising a row of interconnected pocketed coil springs, each of said pocketed coil springs comprising a coil spring surrounded with a pocket of fabric, said pocket of fabric being divided into at least two subpockets by at least one line of attachment, each of said subpockets containing one portion of said coil spring.

14. The string of springs of claim 13 wherein each of said coil springs has at least two portions of different characteristics.

15. The string of springs of claim 13 wherein each of said coil springs has two different portions, each of said portions being within one of said subpockets.

16. The string of springs of claim 14 wherein said portions of said coil spring are of different thicknesses.

17. The string of springs of claim 14 wherein said portions of said coil spring are of different pitches.

18. The string of springs of claim 13 wherein said string of springs is joined to other similar strings of springs by gluing strings of springs together to create a spring core.

19. The string of springs of claim 13 wherein each of said coil springs has three portions, a pair of end portions and a middle portion, each of said end portions having identical characteristics.

20. The string of springs of claim 19 wherein said middle portion of said coil spring has different characteristics than the characteristics of said end portions.

21. A pocketed coil spring for use in a bedding or seating product, said pocketed coil spring comprising a coil spring surrounded with a pocket of fabric, said pocket of fabric being divided into at least two subpockets by at least one line of attachment, wherein each of said subpockets contains one portion of said coil spring.

22. The pocketed coil spring of claim 21 wherein said coil spring has two different portions, each of said portions being within one of said subpockets.

23. The pocketed coil spring of claim 21 wherein said coil spring has at least two portions of different characteristics.

24. The pocketed coil spring of claim 23 wherein said portions of said coil spring are of different thicknesses.

25. The pocketed coil spring of claim 23 wherein said portions of said coil spring are of different pitches.

26. The pocketed coil spring of claim 23 wherein said coil spring has three portions, a pair of end portions and a middle portion, each of said end portions having identical characteristics.

27. The pocketed coil spring of claim 26 wherein said middle portion of said coil spring has different characteristics than the characteristics of said end portions.

* * * * *